US005405136A

United States Patent [19]

Hardman

[11] Patent Number: 5,405,136

[45] Date of Patent: Apr. 11, 1995

[54] GOLF CLUB WITH FACE INSERT OF VARIABLE HARDNESS

[75] Inventor: Thomas F. Hardman, Palm Beach Gardens, Fla.

[73] Assignee: Wilson Sporting Goods Co., Chicago, Ill.

[21] Appl. No.: 123,113

[22] Filed: Sep. 20, 1993

[51] Int. Cl.[6] ..... A63B 53/04

[52] U.S. Cl. ..... 273/173; 273/78

[58] Field of Search ..... 273/173, 78

[56] References Cited

U.S. PATENT DOCUMENTS

| | | | |
|---|---|---|---|
| 1,485,685 | 3/1924 | McMahon | 273/173 |
| 1,535,670 | 4/1925 | Kidd | 273/173 |
| 1,562,956 | 11/1925 | Guerne | 273/173 |
| 1,567,248 | 12/1925 | Dahlman | 273/173 X |
| 1,654,257 | 12/1927 | Hillerich | 273/173 |
| 1,659,272 | 2/1928 | Link | 273/173 |
| 1,840,451 | 1/1932 | Jansky | 273/173 |
| 2,034,936 | 3/1936 | Barnhart | 273/173 x |
| 2,201,638 | 5/1940 | Theibault | 273/77 |
| 2,846,228 | 8/1958 | Reach | 273/173 X |
| 4,181,306 | 1/1980 | Jepson | 273/173 |
| 4,252,262 | 2/1981 | Igarashi | 273/173 X |
| 4,420,156 | 12/1983 | Campao | 273/77 A |
| 4,471,961 | 9/1984 | Masghati | 273/175 |
| 4,681,322 | 7/1987 | Straza | 273/173 |
| 4,730,830 | 3/1988 | Tilley | 273/173 X |
| 4,768,787 | 9/1988 | Shira | 273/173 X |
| 4,792,140 | 12/1988 | Yamaguchi | 273/173 |
| 4,801,146 | 1/1989 | Honma | 273/173 |
| 4,809,978 | 3/1989 | Yamaguchi | 273/173 X |
| 4,883,274 | 11/1989 | Hsien | 273/173 X |
| 4,884,812 | 12/1989 | Nagasaki | 273/173 X |
| 4,964,640 | 10/1990 | Nakanishi | 273/173 X |
| 5,016,883 | 5/1991 | Kobayashi | 273/173 X |
| 5,024,437 | 6/1991 | Anderson | 273/173 X |
| 5,062,638 | 11/1991 | Shira | 273/173 X |
| 5,064,197 | 11/1991 | Eddy | 273/173 X |
| 5,082,278 | 1/1992 | Hsien | 273/173 X |
| 5,083,778 | 1/1992 | Douglass | 273/173 X |

FOREIGN PATENT DOCUMENTS 2259863 3/1993 United Kingdom .

OTHER PUBLICATIONS

1993 Mizuno advertisement for Ti-22 Iron.

*Primary Examiner*—William H. Grieb

[57] ABSTRACT

A golf clubhead includes a face insert whose hardness varies from the center of the face insert to the outside of the face insert for compensating for off-center hits. The hardness of the face insert can be varied by forming the face insert from a plurality of rings or by varying the thickness of the insert.

17 Claims, 3 Drawing Sheets

Fig. 1
Prior Art
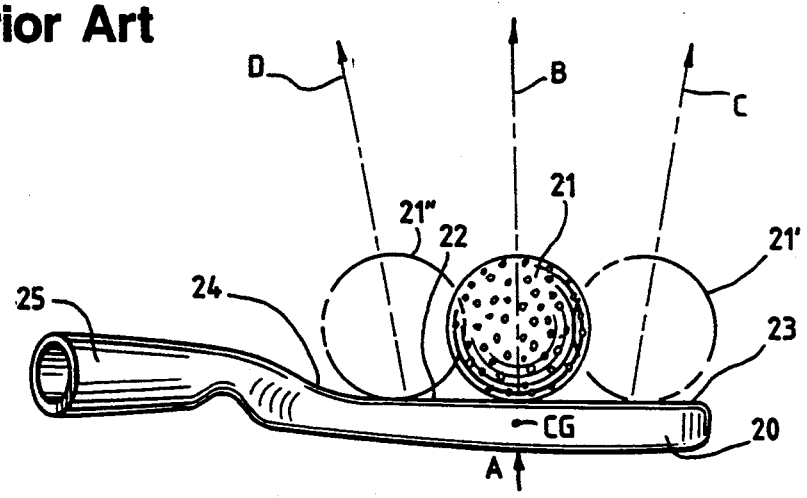
Fig. 2
Prior Art
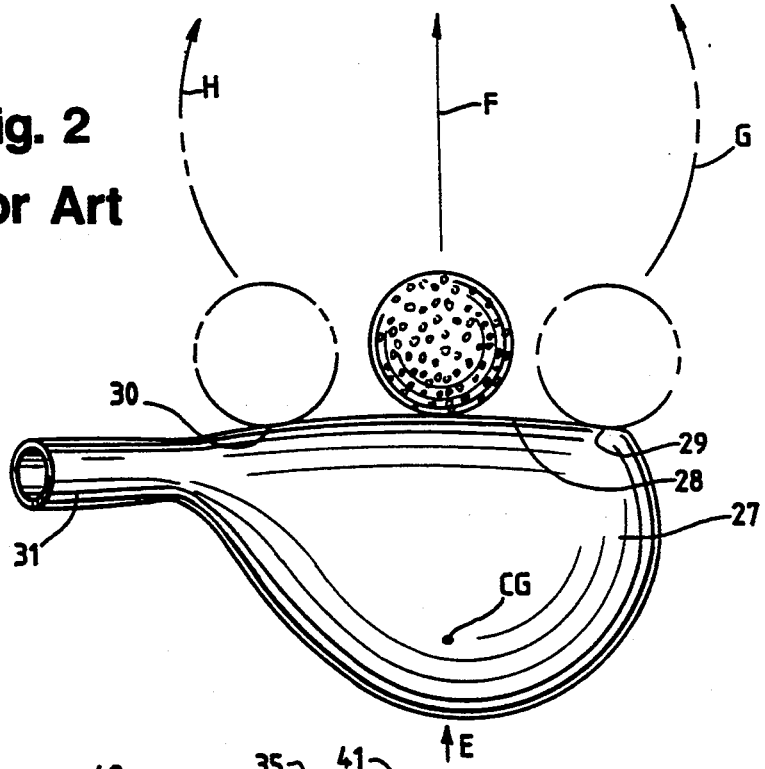
Fig. 4
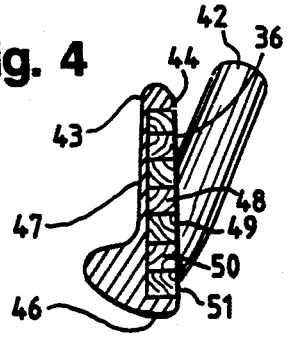
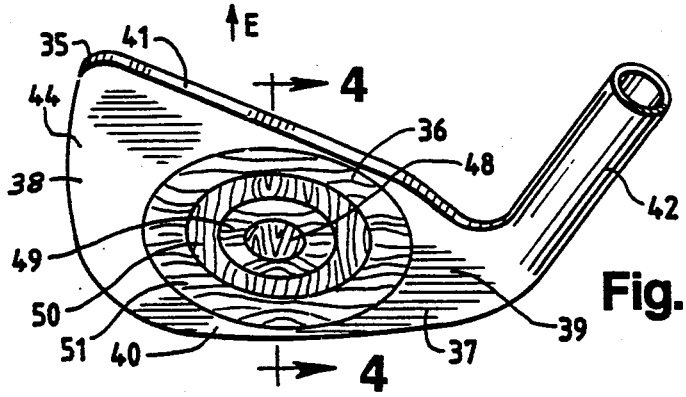
Fig. 3

Fig. 6
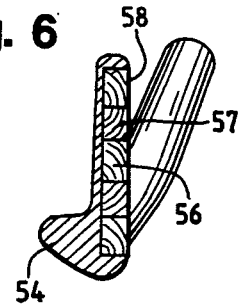
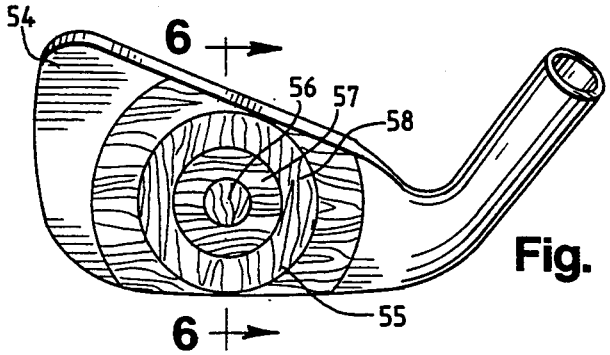
Fig. 5
Fig. 8
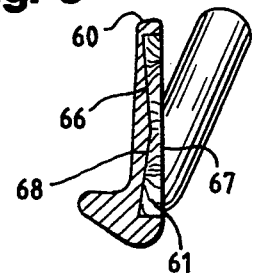
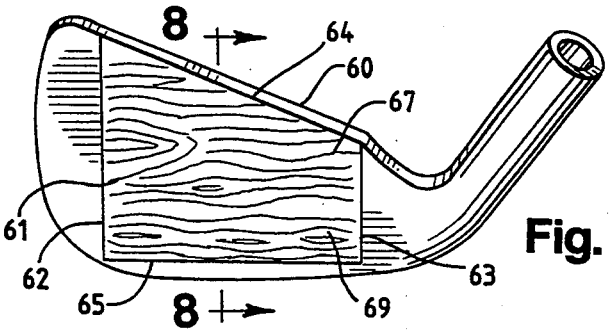
Fig. 7
Fig. 10
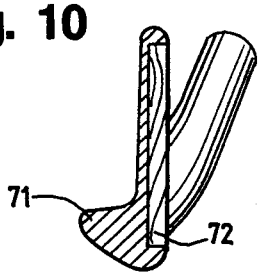
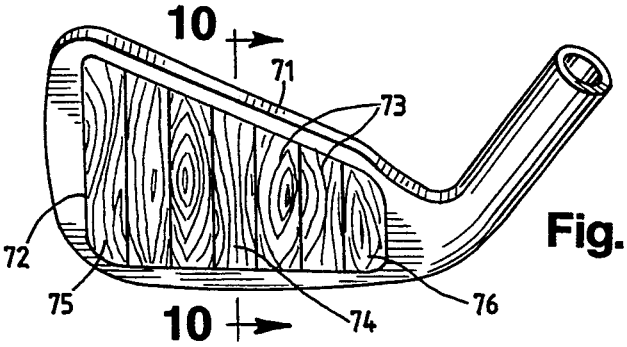
Fig. 9
Fig. 12
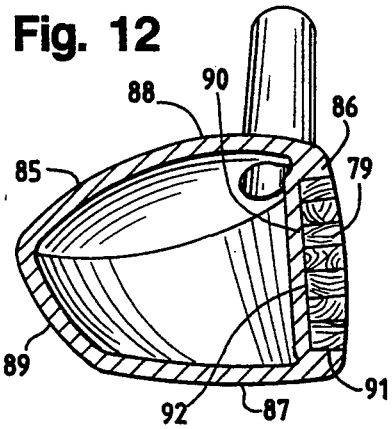
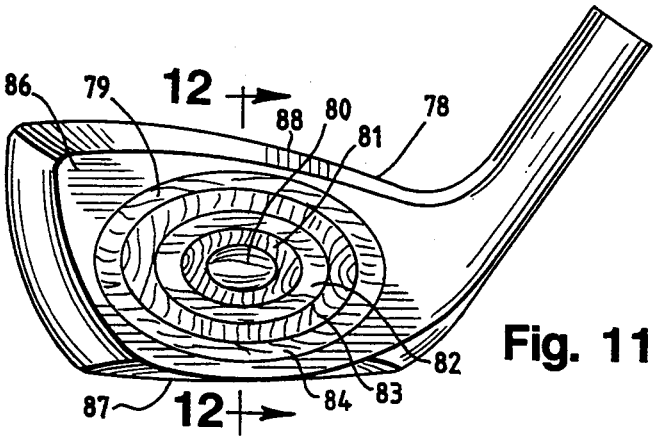
Fig. 11

Fig. 14
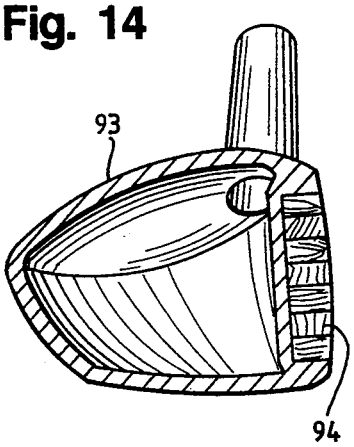
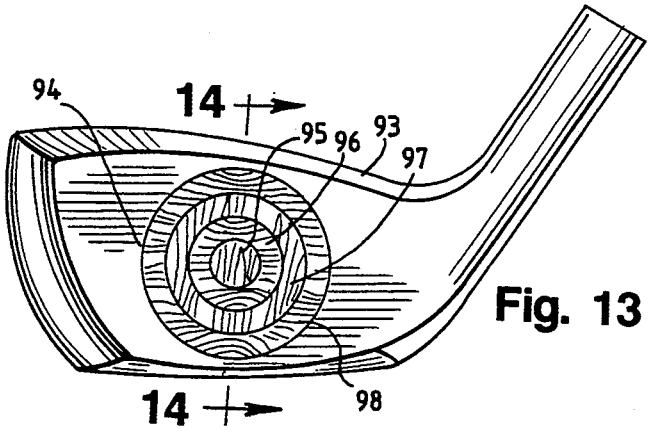
Fig. 13
Fig. 16
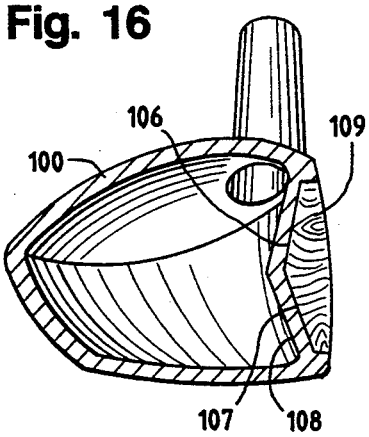
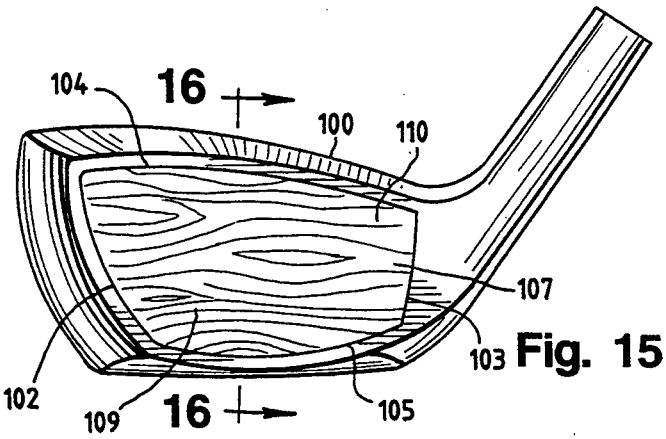
Fig. 15
Fig. 18
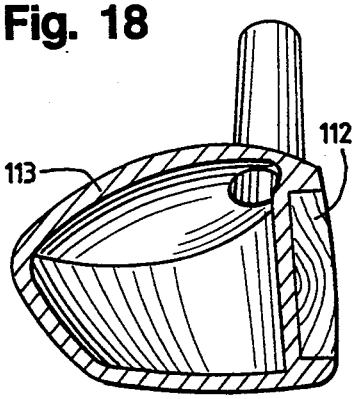
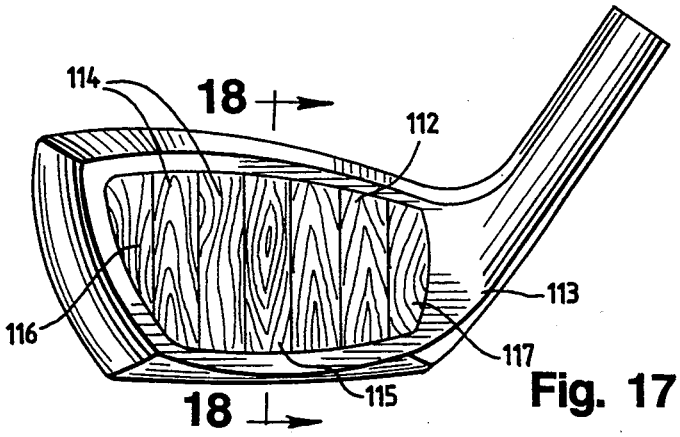
Fig. 17

GOLF CLUB WITH FACE INSERT OF VARIABLE HARDNESS

BACKGROUND

This invention relates to a face insert for a golf clubhead, and, more particularly, to a face insert having a variable hardness.

Golf clubheads fall into two general categories—wood-type clubheads and iron-type clubheads. In the past wood-type clubheads have usually been made of wood, but in recent years wood-type clubs have predominantly been made from metal. As used herein, "wood-type" clubheads include both wood and metal clubheads.

A golf ball generally travels straightest when it is struck by a golf clubhead when the face of the clubhead is square to the intended line of flight of the ball and the center of gravity of the clubhead is aligned with the ball. When the ball is struck off-center, i.e., toward the toe or the heel of the clubhead, the ball tends to travel away from the intended line of flight.

When an iron clubhead strikes a ball on the toe portion of the clubhead, the ball tends to be projected to the right of the line of flight. When the ball is contacted by the heel of the clubhead, the ball tends to be projected to the left of the intended line of flight. Balls contacted above center tend to go up, and balls contacted below center tend to go down.

Conversely, when a ball is contacted by the toe of a wood-type of clubhead, the ball tends to curve to the left because of the gear effect of the wood clubhead. When a ball is contacted by the heel of a wood type of clubhead, the ball tends to curve to the right because of gear effect. Balls contacted above center tend to go down and balls contacted below center tend to go up. See U.S. Pat. Nos. 4,420,156 and 4,471,961 for a discussion of gear effect. In order to counteract or compensate for gear effect, the face of a wood-type clubhead is generally provided with bulge and roll curvatures as described in U.S. Pat. Nos. 4,420,156 and 4,471,961.

Face inserts have been used for many years on wooden clubheads. Face inserts are now approved for metal clubheads by the Rules of Golf of the Untied States Golf Association. However, the face inserts have generally been formed from uniform material and have not been constructed to compensate for off-center hits.

SUMMARY OF THE INVENTION

The invention provides a face insert for a clubhead which has a variable effective hardness from the center of the insert to the outside of the insert. The "effective hardness" of the insert refers to the total hardness of the clubhead and the insert which is exerted on the golf ball rather than to the hardness of the insert material alone. The effective hardness of the face insert can be varied by forming the insert from rings of material of different hardness or by varying the thickness of insert material itself. Face inserts for iron clubheads have a greater effective hardness at the outside of the insert than at the center of the insert to compensate for off-center hits. Face inserts for wood-type clubheads have a greater effective hardness at the center of the insert than at the outside of the insert to compensate for off-center hits.

DESCRIPTION OF THE DRAWING

The drawing will be explained in conjunction with illustrative embodiments shown in the accompanying drawing, in which—

FIG. 1 is a schematic illustration of the flight of a golf ball when struck with a conventional iron clubhead;

FIG. 2 is a schematic illustration of the flight of a golf ball when struck with a conventional wood-type clubhead;

FIG. 3 is a front elevational view of an iron clubhead with a face insert of variable hardness;

FIG. 4 is a sectional view taken along the line 4—4 of FIG. 3;

FIG. 5 is a view similar to FIG. 3 of a clubhead with a modified face insert of variable hardness;

FIG. 6 is a sectional view taken along the line 6—6 of FIG. 5;

FIG. 7 is a view similar to FIG. 3 of a clubhead with another embodiment of a face insert;

FIG. 8 is a sectional view taken along the line 8—8 of FIG. 7;

FIG. 9 is a view similar to FIG. 3 of still another embodiment of a face insert;

FIG. 10 is a sectional view taken along the line 10—10 of FIG. 9;

FIG. 11 is a front elevational view of a wood-type clubhead with a face insert of variable hardness;

FIG. 12 is a sectional view taken along the line 12—12 of FIG. 11;

FIG. 13 is a view similar to FIG. 11 of a clubhead with another embodiment of a face insert;

FIG. 14 is a sectional view taken along the line 14—14 of FIG. 13;

FIG. 15 is a view similar to FIG. 11 of yet another embodiment of a face inset;

FIG. 16 is a sectional view taken along the line 16—16 of FIG. 15;

FIG. 17 is a view similar to FIG. 11 of another embodiment of a face insert; and FIG. 18 is a sectional view taken along the line 18—18 of FIG. 17.

DESCRIPTION OF SPECIFIC EMBODIMENTS

FIG. 1 illustrates a conventional iron clubhead 20 and a golf ball 21. The clubhead includes a face 22, a toe portion 3, a heel portion 24, and a hosel 25 which is connected to a shaft (not shown). When the clubhead moves in the direction of the arrow A and strikes the ball with the center of gravity CG of the clubhead aligned with the ball, as illustrated by the ball 21 in solid outline, the ball will travel in the direction indicated by the arrow B. When the clubhead contacts the ball 21' indicated in phantom at the toe portion, the ball tends to travel in the direction indicated by the arrow C. When the clubhead contacts the ball 21' on the heel portion, the ball tends to travel in the direction of the arrow D.

FIG. 2 illustrates a conventional wood-type clubhead 27 which includes a face 28, a toe portion 29, a heel portion 30, and a hosel 31. The face is curved slightly to compensate for gear effect. When the clubhead moves in the direction E and contacts the ball 21 with the center of gravity CG aligned with the ball, the ball will travel in the direction of arrow F. When the ball 21 is contacted by the toe portion 29, the ball will initially start out right and, because of gear effect, will curve back toward center as indicated by the arrow G. Then the ball 21 is contacted by the heel portion, the ball will start left and curve toward center as indicated by the arrow G.

FIGS. 3 and 4 illustrate an iron clubhead 35 which includes a face insert 36 of variable hardness. The clubhead includes a metal body 37 which can be formed by conventional forging or casting techniques from conventional clubhead materials, for example low-carbon steel, stainless steel, beryllium copper alloy, etc.

The body includes a toe portion 38, a heel portion 39, a sole 40, a top edge 41, a hosel 42, a back 43, and a front surface or face 44 which surrounds the insert 36. The insert 36 is secured within a recess 46 in the body having a bottom wall 47.

In the embodiment illustrated in FIGS. 3 and 4, the periphery of the insert 36 is generally elliptical, and the insert is formed from a generally elliptical center portion 48 and a plurality of generally elliptical rings 49, 50, and 51. The center 48 and each of the rings 49–51 are formed from material having a different hardness. The material of the center 48 has the lowest hardness, the material of the first ring 49 has the next lowest hardness, and so on to the outer ring 51. For example, the center can have a Shore A hardness of 40, the outer ring 51 can have a Shore A hardness of 80, and the intermediate rings can have intermediate hardnesses. The center 48 and the rings 49–51 can be formed from any suitable insert material for example, Cycolac plastic, Surlyn, Epoxy composite, etc. The hardness of the insert will generally be considerably less than the hardness of the metal clubhead material.

When a golf ball is struck by the toe or heel portion of the face insert, the relatively hard material of the outer portion of the face insert compared to the softer material toward the center of the face insert will cause the ball to be projected toward the intended line of flight, i.e., the arrow B in FIG. 1. Similarly, when the top or bottom portions of the face insert strike the ball, the ball is projected toward the flight path of a center hit.

The elliptical face insert 36 illustrated in FIG. 3 has its major axis generally aligned with the ground plane, i.e., a plane which is tangent to the point of contact between the sole 40 and the ground when the clubhead is soled on the ground at the proper lie angle. The minor axis of the ellipse then extends vertically. However, in accordance with the principles discussed in U.S. Pat. Nos. 4,471,961 and 5,120,062, the minor axis of the elliptical insert can extend at an angle from the vertical, for example, at an angle approaching the lie angle of the hosel or from about 35° to about 55° from the vertical.

FIG. 5 illustrates a clubhead 54 with a face insert 55. The face insert 55 is similar to the face insert 36 except that the insert 55 is circular. The insert 55 includes a circular center 56 and first and second circular rings 57 and 58 which are made from materials of varying hardness, for example, 40 Shore A for the center 56 to 80 shore A for the outer ring 58.

FIGS. 7 and 8 illustrate a clubhead 60 with a generally trapezoidally shaped face insert 61. The insert includes generally parallel toe and heel edges 62 and 63 and top and bottom edges 64 and 65. The back surface 66 of the insert is generally conical-concave so that the central portion 67 of the insert is thinner than the edge portions of the insert. The bottom wall 68 of the recess in the clubhead is a complementary conical-convex shape and abuts the concave surface of the insert.

Although the material of the insert 61 is uniform, the thinner central portion 67 which is backed by the metal wall of the clubhead has a lower effective hardness than the thicker edge portions of the insert. "Effective hardness" as used herein means the hardness which is "felt" by the golf ball when the ball is struck by the combined insert and clubhead body. In FIG. 7, the effective hardness of the central portion 67 is 40 Shore A, the effective hardness of the edge portions of the insert is 65 Shore A, and the effective hardness of the intermediate portions of the insert vary between 40 and 65, for example, 50 in the area designated by the reference numeral 69.

FIGS. 9 and 10 illustrate still another embodiment of an iron clubhead 71 with a face insert 72. The face insert comprises a plurality of strips 73 of varying hardness, the strips being arranged generally perpendicularly to the sole of the clubhead. The center strip 74 has the lowest hardness, and the hardness of the strips increases toward the toe strip 75 and heel strip 76.

FIGS. 11 and 12 illustrate a wood-type clubhead 78 with an elliptical face insert 79. The face insert 79 is similar to the elliptical face insert 36 illustrated in FIG. 3 and includes a central portion 80 and a plurality of elliptical rings 81, 82, 83, and 84. However, in contrast to the insert for the iron clubhead, the insert for the wood clubhead is hardest at the center and softest at the outside. In FIG. 11 the hardness of the center portion 80 is 80 Shore A, the hardness of the outer ring 84 is 40 Shore A, and the hardness of the rings 81, 82, and 83 are between 80 and 40, for example, 70, 60, and 50, respectively.

The wood clubhead 79 includes a body 85, which can be either wood or metal, and the body includes a face 86, a sole 87, a top wall 88, and a side wall 89. The insert 79 is positioned in a recess 90 in the face of the club, the recess having a side wall 91 and a bottom wall 92.

When a golf ball is contacted by the toe or heel portions of the clubhead 78, the lower hardness of the outer rings of the insert compared to the relatively hard center will tend to project the ball away from the intended line of flight indicated at F in FIG. 2. However, the gear effect of the wood clubhead will make the ball curve toward the line F. Similarly, if the ball is contacted at the top or bottom of the face insert, the ball will tend to be projected at a higher or lower launch angle than for a center hit, and gear effect will make the ball curve back toward the intended launch angle.

The face of the wood clubhead 78 which is formed by the face 86 of body and the insert 79 may be provided with bulge and roll curvatures. However, because the variable hardness face insert tends to correct for off-center hits, the bulge and roll curvatures may be reduced or eliminated.

FIGS. 13 and 14 illustrate a wood-type clubhead 93 with a circular face insert 94. The face insert has a circular central portion 95 and circular rings 96, 97, and 98. The hardness of the central portion 95 may be 80 Shore A, the hardness of the outer ring 98 may be 40 Shore A, and the hardness of the inner rings 96 and 97 may have intermediate hardness.

FIGS. 15 and 16 illustrate a wood-type clubhead 100 with a face insert 101. The insert has toe and heel edges 102 and 103, top and bottom edges 104 and 105, and a generally conical-convex back surface 106. The clubhead has a recess 107 with a complementary shaped conical-concave bottom wall 108. The central portion 109 of the insert is thicker than the edge portions, and the central portion has a greater effective hardness than the edge portions. In the embodiment illustrated in FIGS. 15 and 16, the effective hardness at the central portion is 65 Shore A, the effective hardness at the edge portion is 40 Shore A, and the effective hardness at an intermediate point 110 is 50 Shore A.

FIGS. 17 and 18 illustrate another embodiment of a face insert 112 for a clubhead 113. The insert comprises a plurality of vertical strips 114 of varying hardness. The center strip 115 has the highest hardness, and the end strips 116 and 117 have the lower hardness.

While in the foregoing specification, a detailed description of a specific embodiment of the invention was set forth for the purpose of illustration, it will be understood that many of the details herein given may be varied considerably by those skilled in the art without departing from the spirit and scope of the invention.

I claim:

1. A golf clubhead comprising a clubhead body and a face insert attached to the body, the face insert being adapted to hit a golf ball, each of the body and the face insert having a toe portion, a heel portion, a sole portion, and a top portion, the face insert also having a center portion, the effective hardness of the face insert being different at the center portion of the face insert and at the toe and heel portions of the face insert, the face insert including a plurality of parallel strips of different effective hardness which extend generally perpendicularly to the sole portion of the clubhead body.

2. A golf clubhead comprising a clubhead body and a face insert attached to the body, the face insert being adapted to hit a golf ball, the body having a toe, a heel, a sole, and a top, the face insert having a central portion, a first toe portion between the central portion and the toe of the clubhead, a second toe portion between the first toe portion and the toe of the clubhead, a first heel portion between the central portion and the heel of the clubhead, and a second heel portion between the first heel portion and the heel of the clubhead, the material of the insert having a lower hardness than the material of the clubhead body, the effective hardness of the central portion being less than the effective hardness of the first toe and heel portions, the effective hardness of the first toe and heel portions being less than the effective hardness of the second toe and heel portions.

3. The golf clubhead of claim 2 in which the first toe and heel portions are provided by a first ring which extends around the central portion of the face insert and the second toe and heel portions are provided by a second ring which extends around the first ring.

4. The golf clubhead of claim 3 in which said rings are substantially concentric and circular.

5. The golf clubhead of claim 3 in which said rings are substantially elliptical.

6. The golf clubhead of claim 2 in which said portions of the face insert are provided by a plurality of parallel strips which extend generally perpendicularly to the sole portion of the clubhead body.

7. The golf clubhead of claim 2 in which the face insert includes a third toe portion between the second toe portion and the toe of the clubhead body and a third heel portion between the second heel portion and the heel of the clubhead body, the effective hardness of the second toe and heel portions being less than the effective hardness of the third toe and heel portions.

8. The golf clubhead of claim 2 in which the clubhead is an iron-type clubhead.

9. The clubhead of claim 2 in which the first toe and heel portions are thicker than the central portion of the face insert and the second toe and heel portions are thicker than the first toe and heel portions.

10. A golf clubhead comprising a clubhead body and a face insert attached to the body, the face insert being adapted to hit a golf ball, the body having a toe, a heel, a sole, and a top, the face insert having a central portion, a first toe portion between the central portion and the toe of the clubhead, a second toe portion between the first toe portion and the toe of the clubhead, a first heel portion between the central portion and the heel of the clubhead, and a second heel portion between the first heel portion and the heel of the clubhead, the material of the insert having a lower hardness than the material of the clubhead body, the effective hardness of the central portion being greater than the effective hardness of the first toe and heel portions, the effective hardness of the first toe and heel portions being greater than the effective hardness of the second toe and heel portions.

11. The golf clubhead of claim 10 in which the first toe and heel portions are provided by a first ring which extends around the central portion of the face insert and the second toe and heel portions are provided by a second ring which extends around the first ring.

12. The golf clubhead of claim 11 in which said rings are substantially concentric and circular.

13. The golf clubhead of claim 11 in which said rings are substantially elliptical.

14. The golf clubhead of claim 10 in which said portions of the face insert are provided by a plurality of parallel strips which extend generally perpendicularly to the sole portion of the clubhead body.

15. The golf clubhead of claim 10 in which the face insert includes a third toe portion between the second toe portion and the toe of the clubhead body and a third heel portion between the second heel portion and the heel of the clubhead body, the effective hardness of the second toe and heel portions being greater than the effective hardness of the third toe and heel portions.

16. The golf clubhead of claim 10 in which the clubhead is a wood-type clubhead.

17. The golf clubhead of claim 10 in which the first toe and heel portions are thinner than the central portion of the face insert and the second toe and heel portions are thinner than the first toe and heel portions.

* * * * *